US012391427B2

(12) United States Patent
Lee

(10) Patent No.: US 12,391,427 B2
(45) Date of Patent: Aug. 19, 2025

(54) TRAY FOR CONVEYING CUP AND CONTAINER

(71) Applicant: Seojeong Lee, Suwon-si (KR)

(72) Inventor: Seojeong Lee, Suwon-si (KR)

( * ) Notice: Subject to any disclaimer, the term of this patent is extended or adjusted under 35 U.S.C. 154(b) by 0 days.

(21) Appl. No.: 17/472,699

(22) Filed: Sep. 13, 2021

(65) Prior Publication Data

US 2022/0081154 A1 Mar. 17, 2022

(30) Foreign Application Priority Data

Sep. 14, 2020 (KR) ..... 10-2020-0117764
Mar. 15, 2021 (KR) ..... 10-2021-0033434

(51) Int. Cl.
*B65D 5/50* (2006.01)
*B65D 5/36* (2006.01)
*B65D 5/468* (2006.01)

(52) U.S. Cl.
CPC ..... *B65D 5/5021* (2013.01); *B65D 5/3635* (2013.01); *B65D 5/4608* (2013.01)

(58) Field of Classification Search
CPC .. B65D 5/5021; B65D 5/3635; B65D 5/4608; B65D 5/427; B65D 5/5035; B65D 5/20; B65D 71/72; B65D 71/70; B65D 71/0007
USPC ..... 206/562, 560, 563, 564, 565
See application file for complete search history.

(56) References Cited

U.S. PATENT DOCUMENTS 1,757,141 A * 5/1930 Raster ..... B65D 25/04 220/533
3,107,028 A * 10/1963 De Robertis ..... A47G 23/0216 215/396

* cited by examiner

*Primary Examiner* — Andrew D Perreault

(57) ABSTRACT

The present invention is to provide a tray for conveying a cup and a container, which is coupled to a cup holder and is capable of stably conveying multiple cups and containers in a simple structure by effectively preventing a motion of the cup, and may include: a body part having a space accommodating at least one of a cup or a food; and at least one fastening unit positioned on one side of the body part and into which a protrusion of an external member (a cup and a container) is inserted and coupled into, and the fastening portion has a slit or a cutting line having a clamp shape.

1 Claim, 10 Drawing Sheets

(a)

(a)

(b)

[FIG. 1a]
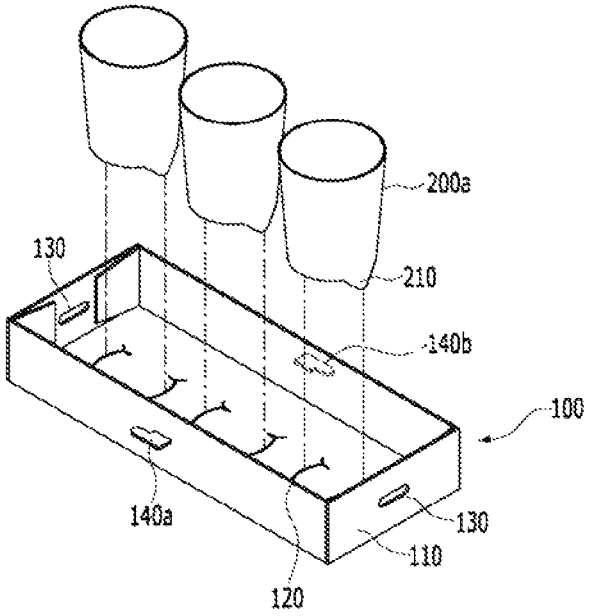
[FIG. 1b]
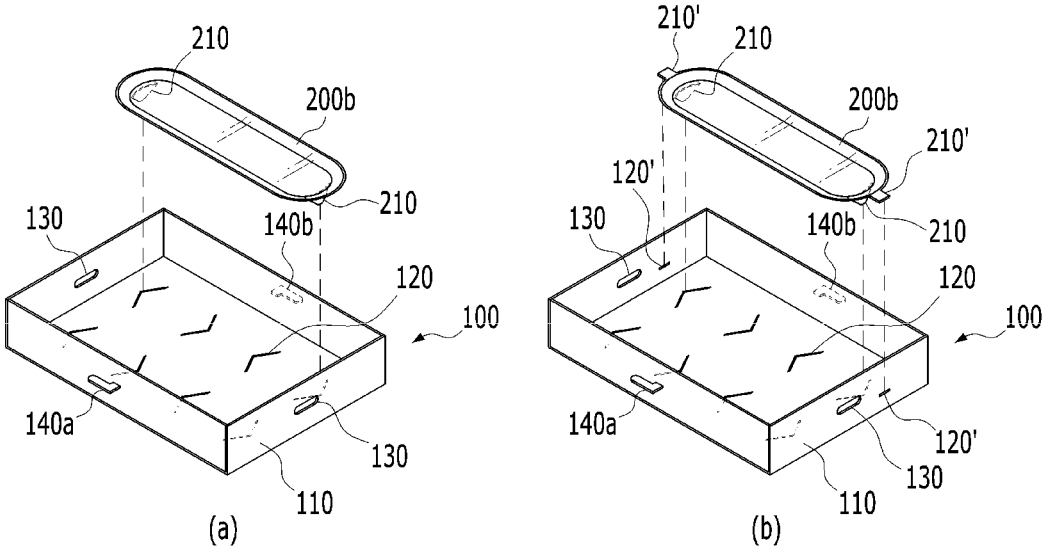

[FIG. 1c]
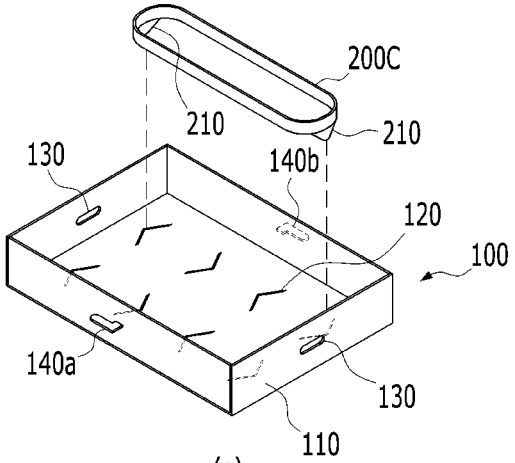
(a)

[FIG. 2a]
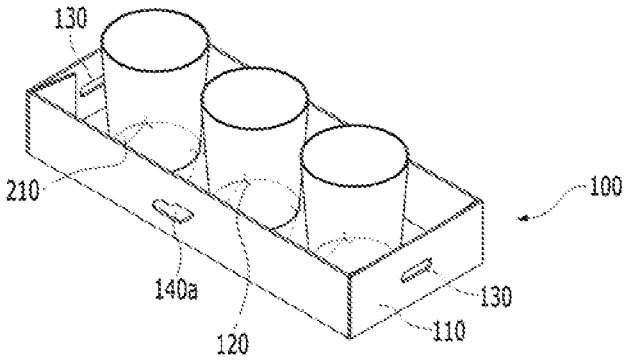
(a)
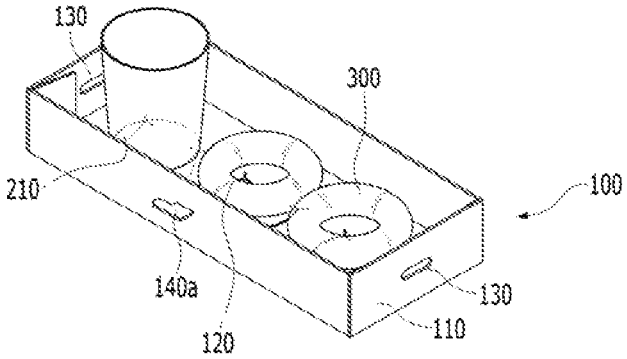
(b)

[FIG. 2b]
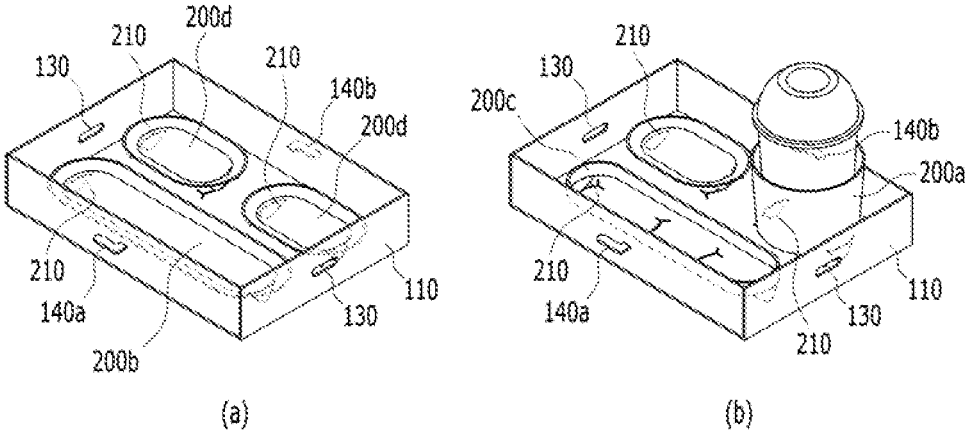

[FIG. 3a]
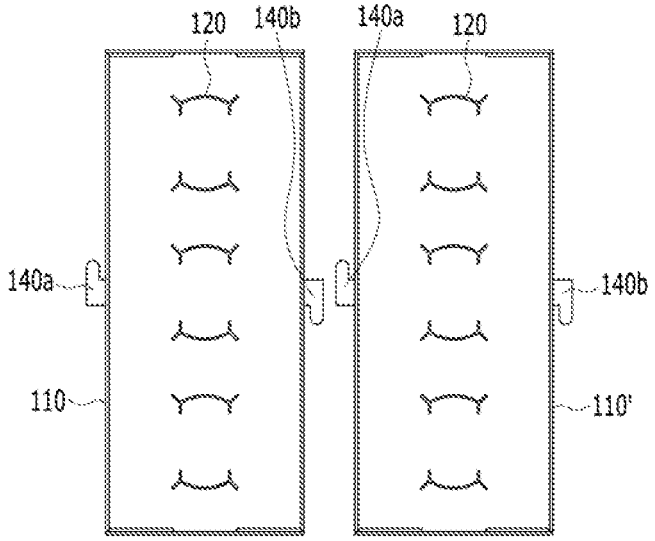
[FIG. 3b]
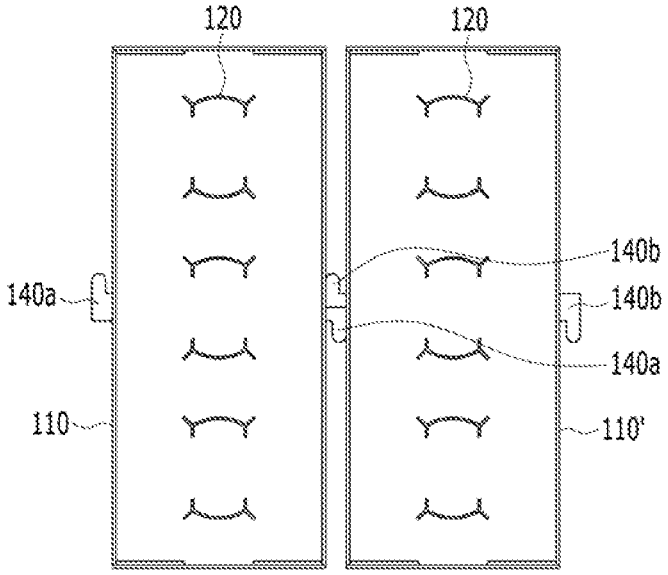
(b)

[FIG. 4a]
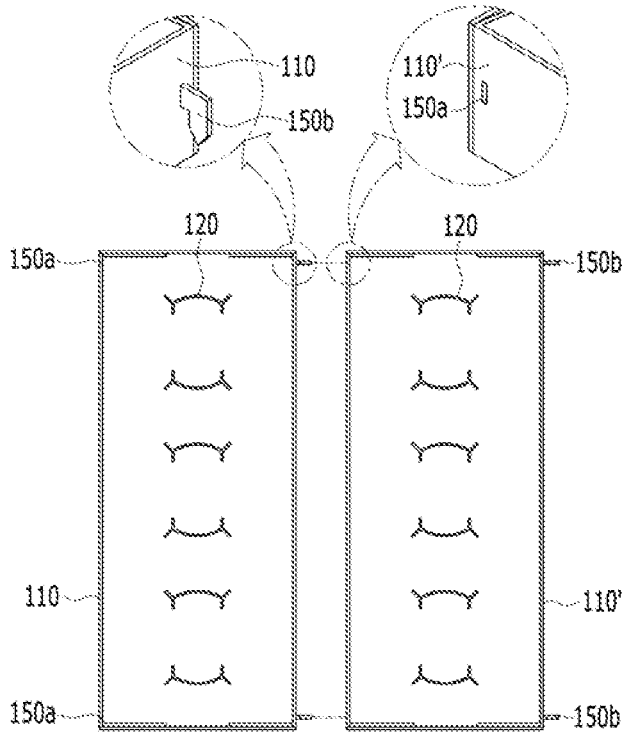
[Fig. 4b]
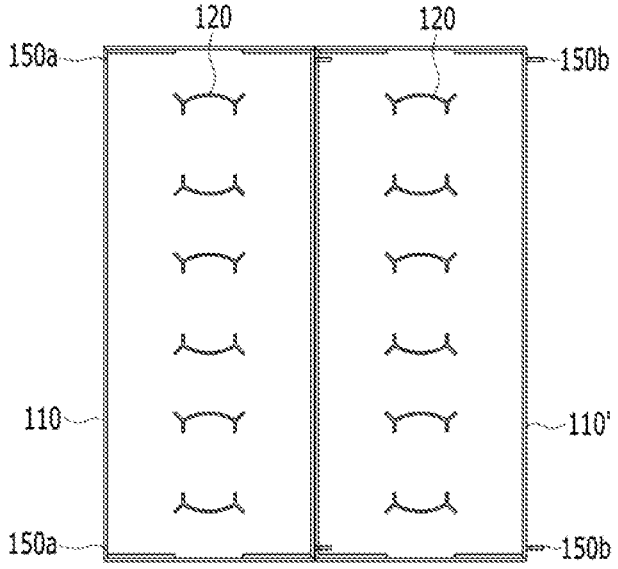

[FIG. 5]
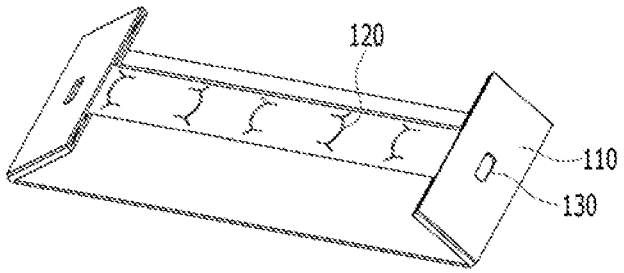
[FIG. 6]
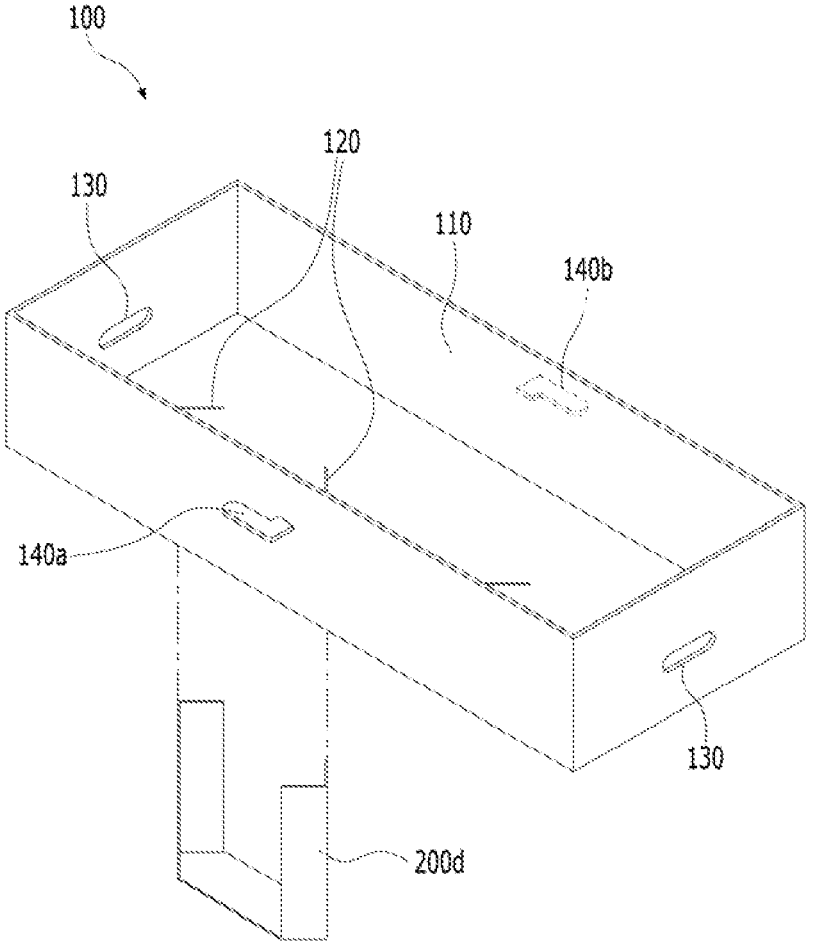

[FIG. 7a]
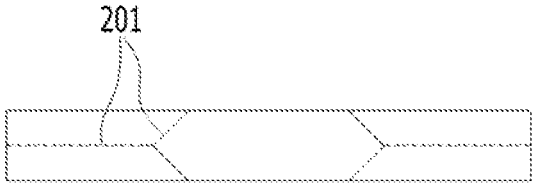
[FIG. 7b]
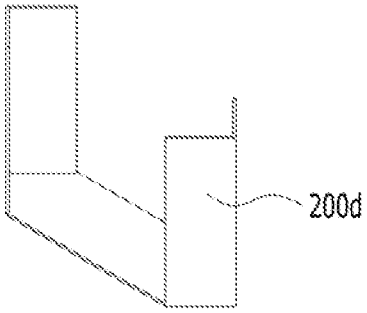

[FIG. 8]
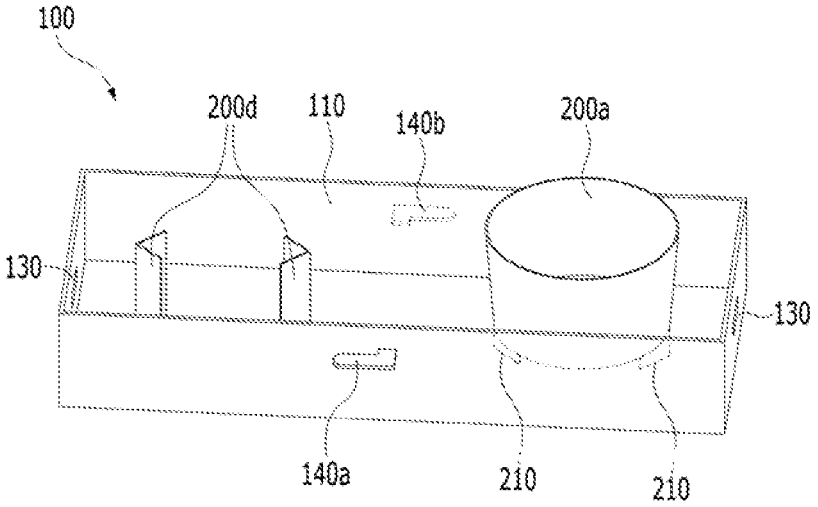
(a)
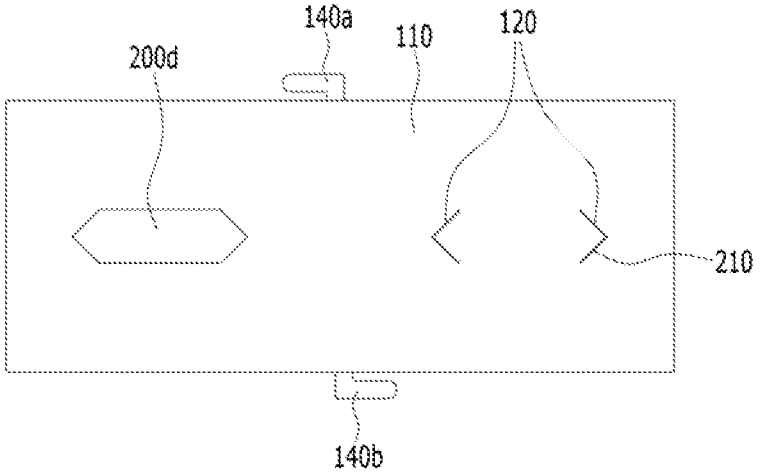
(b)

[FIG. 9]
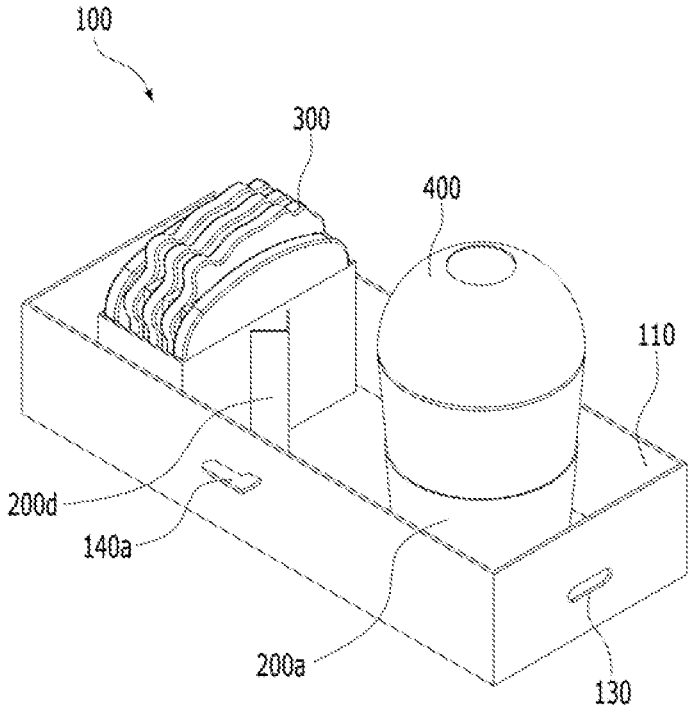

TRAY FOR CONVEYING CUP AND CONTAINER

TECHNICAL FIELD

The present invention relates to a tray for conveying a cup and a container, which is used for easily conveying multiple cups and containers, and particularly, to a tray for conveying a cup and a container, which is coupled to a cup holder and a dish (vessel) and effectively prevents motions of the cup and the container to stably convey multiple cups and containers only by a simple structure.

BACKGROUND ART

In recent years, the number of take-out type coffee shops has been increasing. The coffee shop provides a cup carrier and tray for conveniently conveying multiple cups when one or more cups of coffee is ordered, and the cup carrier and tray becomes a major necessity that should be provided in the coffee shop.

That is, the take-out type coffee shop can sell one or more cups of coffee according to an order of a customer. In this case, it may be difficult that one customer moves while holding one or more cups. In particular, it may be difficult for one person to hold and convey two or more cups containing hot and cold coffee with both hands.

As a result, the coffee shop uses the cup carrier and tray for a purpose in which one customer can easily convey multiple cups.

A commonly used disposable cup carrier and tray may have a box type or tray type structure in which a paperboard is pasted with a glue or an adhesive or a tray type structure in which a pulp is poured into a mold and solidified by a scheme of making an eggbox panel.

However, in the case of the cup and tray, a cost weight of a raw material required for production of the cup carrier and tray is large and a manufacturing process is complicated, so manufacturing cost depending on a process becomes large and a volume of a finished product is large, and as a result, costs such as packing cost, conveying cost, and storage cost are largely consumed.

As such, the cup carrier and tray made by the existing used scheme has various problems including a problem that the cup carrier and tray is complicated in terms of the structure and manufacturing process thereof, so a price cannot but be large as a disposable consumable, a problem that the cup carrier tray is inconvenient, and a problem that a weight of logistics cost becomes too large due to a large volume.

DISCLOSURE

Technical Problem

An object of the present invention is to provide a tray for conveying a cup and a container, which is coupled to a cup holder or a dish (container) and effectively prevents motions of the cup and the container to stably convey multiple cups only by a simple structure.

An object of the present invention is to provide a tray for conveying a cup and a container, which is coupled to a cup holder and effectively prevents the motion of the cup to be immediately used without a manufacturing process and does not occupy a large volume in a simple structure of a plate shape and is simple in terms of the manufacturing process to save cost.

An object of the present invention is to provide a tray for conveying a cup and a container, which can save a material and more stably support the cup and the dish (container) in a simple and robust structure.

An object of the present invention is to provide a tray for conveying a cup and a container which can provide a beverage and dessert in a space when purchasing both the beverage and the dessert.

The objects of the present invention are not limited to the above-mentioned objects, and other objects and advantages of the present invention that are not mentioned can be understood by the following description, and will be more clearly understood by embodiments of the present invention. Further, it will be readily appreciated that the objects and advantages of the present invention can be realized by means and combinations shown in the claims.

Technical Solution

In order to achieve the object, a tray for conveying a cup and a container according to the present invention may include: a body part having a space accommodating at least one of a cup or a food; and at least one fastening unit positioned on one side of the body part and into which a protrusion of an external member (a cup and a container) is inserted and coupled into, and the fastening portion has a slit or a cutting line having a clamp shape, and the fastening portion may have a slit or a cutting line having a clamp shape.

Preferably, the tray for conveying a cup and a container may further include a fixation bar penetrated, inserted, and fastened into the fastening portion to form at least one pole to protrude upwards from a bottom surface of the body part.

Preferably, the fixation bar may be provided as a plate part having a predetermined width, and include a folding line having a predetermined distance while both centers correspond to each other, and further include a folding line slantly inwards of the center by extending the folding line.

Advantageous Effects

The tray for conveying the cup and the container according to the present invention described above has the following effects.

First, the tray for conveying the cup and the container according to the present invention is coupled to the cup holder and effectively prevents the motion of the cup to stably convey multiple cups only by a simple structure.

Second, the tray for conveying the cup and the container according to the present invention can be immediately used without the manufacturing process and does not occupy a large volume in the simple structure of the plate shape and is simple in terms of the manufacturing process to save cost.

Third, the tray for conveying the cup and the container according to the present invention can save a material and more stably support the cup and the container in a simple and robust structure.

Fourth, when both the beverage and the dessert are purchased, there is inconvenience in that a cup carrier and a dessert carrier should be separately provided at present, and the tray for conveying the cup and the container according to the present invention as a carrier in which the cup holder and the tray are coupled can provide the beverage and the dessert in one space when taking out the beverage and the dessert.

In addition to the above-described effects, the specific effects of the present invention will be described below together while describing the specific matters for the present invention.

DESCRIPTION OF DRAWINGS

FIGS. 1*a*, 1*b*, and 1*c* are perspective views illustrating a configuration of a tray for conveying a cup and a container according to an embodiment of the present invention.

FIGS. 2*a* and 2*b* are perspective views illustrating a state in which a cup holder and a container is accommodated in the tray for conveying a cup and a container according to the embodiment illustrated in FIGS. 1*a*, 1*b*, and 1*c*.

FIGS. 3*a* and 3*b* illustrate a first embodiment for describing that the tray for conveying a cup and a container in FIG. 1 is fastened by using first and second coupling units.

FIGS. 4*a* and 4*b* illustrate a second embodiment for describing that the tray for conveying a cup and a container in FIG. 1 is fastened by using the first and second coupling units.

FIG. 5 is a perspective view illustrating a state in which the tray for conveying a cup and a container is folded in order to storage the tray for conveying a cup and a container according to the embodiment of the present invention.

FIG. 6 is a perspective view illustrating a configuration of a tray for conveying a cup and a container according to another embodiment of the present invention.

FIGS. 7*a* and 7*b* are configuration diagrams specifically illustrating a configuration of a fixation bar in FIG. 6.

FIG. 8 is a configuration diagram illustrating a configuration in which a fixation bar and a cup holder are coupled to a body part in FIG. 6.

FIG. 9 is a perspective view illustrating a state in which a cup and a food are accommodated in a tray for conveying a cup and a container according to another embodiment of the present invention.

MODES FOR THE INVENTION

Other objects, characteristics, and advantages of the present invention will become apparent through the detailed description of the embodiments referred to in the accompanying drawings.

Terms used in the present invention adopt general terms which are currently widely used as possible by considering functions in the present invention, but the terms may be changed depending on an intention of those skilled in the art, a precedent, emergence of new technology, etc. Further, in a specific case, a term which an applicant arbitrarily selects is present and in this case, a meaning of the term will be disclosed in detail in a corresponding description part of the invention. Accordingly, a term used in the present invention should be defined based on not just a name of the term but a meaning of the term and contents throughout the present invention.

A preferred embodiment of a tray for conveying a cup and a container according to the present invention will be described below with reference to the accompanying drawings. The present invention is not limited to an embodiment disclosed below but may be implemented in various different shapes and the present embodiment just completes a disclosure of the present invention and is provided to completely inform a scope of the present invention to those skilled in the art. Accordingly, configurations illustrated in the embodiments and drawings disclosed in the present specification are only the most preferred embodiment of the present invention and do not represent all of the technical spirit of the present invention, and thus it is to be understood that various equivalents and modified examples, which may replace the configurations, are possible when filing the present application.

Hereinafter, any component being disposed "at an upper portion (or lower portion)" of a component or "above (or below)" a component may mean that any component is disposed in contact with an upper surface (or a lower surface) of the component and another component is interposed between the component and any component disposed above (or below) the component.

Hereinafter, a tray for conveying a cup and a container according to some embodiments of the present invention will be described. The tray for conveying a cup and a container illustrated in the drawings follows an embodiment, and constituent elements thereof are illustrated to the embodiment illustrated in the drawings and if necessary, some constituent elements may be added, modified, or deleted.

FIGS. 1*a*, 1*b*, and 1*c* are perspective views illustrating a configuration of a tray for conveying a cup and a container according to an embodiment of the present invention. In addition, FIGS. 2*a* and 2*b* are perspective views illustrating a state in which a cup holder and a container is accommodated in the tray for conveying a cup and a container according to the embodiment illustrated in FIGS. 1*a*, 1*b*, and 1*c*. That is, FIG. 2*a*(*a*) is a perspective view illustrating a state in which multiple cups are accommodated in the tray for conveying a cup and a container in FIG. 1*a*, and FIG. 2*a*(*b*) is a perspective view illustrating a state in which both the cup and food are accommodated in the tray for conveying a cup and a container in FIG. 1*a*. In addition, FIG. 2*b*(*a*) is a perspective view illustrating a state in which multiple containers are accommodated in the tray for conveying a cup and a container in FIG. 1*b*, and FIG. 2*b*(*b*) is a perspective view illustrating a state in which both the cup and the container are accommodated in the tray for conveying a cup and a container in FIG. 1*a*.

As illustrated in FIGS. 1*a*, 1*b*, and 1*c*, a tray 100 for conveying a cup and a container according to the present invention may include a body part 110 having a space in which at least one of the cup and the container is accommodated, and at least one fastening portion 120 provided on a bottom portion of the body part 110 and into which a protrusion 210 of an external member 200 is inserted and coupled.

In this case, as illustrated in FIGS. 2*a* and 2*b*, the external member 200 may be the cup, a cup holder, a dish, or the container. The cup holder 200*a* may have a hollow reverse truncated conical shape so as to cover the cup. In addition, the container (dish) 200*b* or 200*d* may have different sizes of accommodation spaces so as to contain foods 300 including desserts including a cake, a donut, confectionery, baking, etc., which may be sold together with beverage in a coffee shop or classify the foods 300 from surrounding foods.

In this case, as illustrated in FIG. 1*b*(*a*)(*b*), the container 200*b* may constitute a bottom surface on which the foods 300 may be laid and a peripheral wall which extends to an upper portion of a peripheral portion of the bottom surface at a predetermined height. However, the present invention is not limited thereto, and as illustrated in FIG. 1*c*, in the container 200*c*, upper and lower portions are opened by a scheme of surrounding a periphery of the foods 300 which are directly laid on the bottom surface of the body part 110 and only an oval peripheral wall may be configured so that the periphery is blocked by a surface extending at a predetermined height to separate the foods 300.

However, the cup or the cup holder, or the dish or the container corresponding to the external member 200 may further include at least protrusion 210 which extends and protrudes downward from a body and is inserted into the fastening portion 120. In this case, in respect to the fastening portion 120, the fastening portion 210 is inserted according to the size of the container 200*b* or 200*c* may be distant.

Meanwhile, a location of the protrusion 210 is not limited thereto, and as illustrated in FIG. 1*b*(*b*), the external member 200 may further include at least one protrusion 210' which extends and protrudes to a side surface from the body of the container 200*b* and is inserted into a fastening portion 120' separately provided on one wall surface of the body part 110.

The body part 110 as a surface of which an upper portion is opened and which extends at a predetermined height may be configured in a rectangular box shape in which the periphery is blocked. However, the configuration is not limited thereto. That is, if the upper portion of the body part 110 is opened and the body part 110 includes a bottom portion for supporting the accommodated cup and container, the body part 110 may be configured in various figures including a circular shape, an oval shape, and a polygonal shape, and further, at least one of sides of the figure may be configured to be opened or blocked.

However, for easy description of the tray 100 for conveying the cup and the container according to the present invention, as the configuration of the tray 100 for conveying the cup and the container is illustrated in the drawings in the present disclosure, only a rectangular box type in which plate portions are configured in all peripheries will be described.

The body part 110 may include a handle 130 integrally configured in the body part 110 itself, and first and second coupling portions 140*a* and 140*b* fastened to one side and the other side of the body part 110, respectively opposite to the other side and one side of another body part 110'.

In this case, as illustrated in the drawing, the handle 130 may be configured by a hole type handle having holes into which a part of a hand may be inserted on both opposite side surfaces of the body part 110. However, the configuration of the handle 130 is not limited thereto, and the handle 130 may be configured by a ring type handle which is located on the bottom surface of the body part 110 or both opposite side surfaces of the body part 110, and in which a part of a paperboard of the body part 110 protrudes upward and is formed in a connection ring shape.

In addition, the first and second coupling portions 140*a* and 140*b* are formed by protruding pieces which protrude to one side of the body part 110 and fastened to protruding pieces which protrude to be opposite so as to be fastened to the other side of another body part 110' to be opposite to connect at least two body parts 110 and 110' to each other in a side surface direction. In this case, in the case of the fastened protruding pieces, a protruding piece of the first coupling portion 140*a* may be fastened to a protruding piece of the second coupling portion 140*b*, and the protruding piece of the second coupling portion 140*b* may be fastened to the protruding piece of the first coupling portion 140*a*.

Meanwhile, in the drawing, the first and second coupling portions 140*a* and 140*b* are configured only on both side surfaces, but not limited thereto, and it should be noted that the first and second coupling portions 140*a* and 140*b* may be configured on both side surfaces, i.e., four side surfaces.

Further, as illustrated in FIG. 2*a*(*a*), multiple cups or cup holders may be accommodated in the fastening portion 120 configured in the tray 100 for conveying the cup and the container according to the present invention, but the present invention is not limited thereto.

That is, as illustrated in FIG. 2*a*(*b*), the cup and the foods 300 may be together accommodated in the tray 100 for conveying the cup and the container according to the present invention. Alternatively, the tray 100 may accommodate multiple containers 200*b* and 200*d* having one or more different sizes, which have an accommodation space which may contain the foods 300 including the desserts including the cake, the donut, the confectionery, the baking, etc., which may be sold together with the beverage in the coffee shop or classify the foods 300 from the periphery as illustrated in FIG. 2*b*(*a*) or accommodate both the cup holder 200 and the containers 200*b* and 200*d* as illustrated in FIG. 2*b*(*b*).

When both the beverage and the dessert are purchased at present, there is inconvenience that each of a cup carrier (tray) and a dessert carrier (tray) should be provided. The tray 100 for conveying the cup and the container according to the present invention may provide the dessert 300 such as the beverage and the donut in one space at the time of taking out the dessert 300. In this case, as the fastening portion 120 is configured by a cutting line which is formed to be cuttable through a perforated line, even though the food is contained in the tray 100 for conveying the cup and the container, the food is not extracted through the fastening portion 120.

Further, the inside and the container of the tray 100 for conveying the cup and the container may be made by a food paper that does not a problem even though the food contacts the food paper or an inner surface may be coated with the food paper, in order to directly contain the food.

Through this configuration, the tray 100 for conveying the cup and the container according to the present invention may include all of three functions as the cup carrier (tray), the dessert carrier (tray), or the cup carrier (tray)+the dessert carrier (tray).

FIGS. 3(*a*) and 3(*b*) illustrate a first embodiment for describing that the tray for conveying a cup and a container is fastened by using first and second coupling units. In this case, FIG. 3(*a*) is a diagram illustrating a state before the first body part 110 and the second body part 110' are fastened and FIG. 3(*b*) is a diagram illustrating a state after the first body part 110 and the second body part 110' are fastened.

As illustrated in FIGS. 3(*a*) and 3(*b*), the first and second coupling portions 140*a* and 140*b* as protruding pieces which extend to the body part 110 and protrude are configured by cutting a slit type insertion hole from one surface at the protruding piece. In this case, the first and second coupling portions 140*a* and 140*b* may be formed by replacing insertion holes formed on one side and the other side of the body part 110 with each other.

As an example, when the insertion hole of the first coupling portion 140*a* positioned on one side of the first body part 110 is formed to be cut from one surface (front surface), the insertion hole of the second coupling portion 140*b* positioned on the other side of the second coupling portion 110' is formed to be cut from the other surface (rear surface).

Therefore, cut portions of the first coupling portion 140*a* and the second coupling portion 140*b* are opposite to each other and the insertion holes are fitted and coupled to cross each other, and as a result, the first body part 110 and the second body part 110' are fastened, not separated and fixed.

In this case, the first body part 110 and the second body part 110' support a load of loaded contents (external member 200) from the top to the bottom. In addition, in the first and second coupling portions 140*a* and 140*b* positioned on the side surfaces of the first body part 110 and the second body part 110', when the formed insertion holes are cut front and back (or left and right), and the cut portions are opposite to each other and the insertion holes are fitted and coupled to cross each other, and as a result, the first body part 110 and the second body part 110' are fastened to each other, the cut, the cup holder, the container, etc., may be supported in a rigid structure with the loaded generated from the top the bottom.

FIGS. 4(*a*) and 4(*b*) illustrate a second embodiment for describing that the tray for conveying a cup and a container in FIG. 1 is fastened by using the first and second coupling units.

As illustrated in FIGS. 4(*a*) and 4(*b*), in the first and second coupling portions 150*a* and 150*b*, at least one protruded protruding piece 150*b* is formed on one side of the body part 110 and at least one fitting groove 150*a* into which the protruding piece 150*b* is fitted is formed on the other side of the body part 110.

Accordingly, the protruding piece which is the first coupling portion 150*a* of the first body part 110 is coupled to the fitting groove 150*a* which is the second coupling portion 150*b* of the second body part 110', and as a result, first and second body parts 110 and 110' may be rigidly coupled to each other.

As illustrated in FIGS. 3, and 4(*a*) and 4(*b*), a plurality of body parts 110 are connected by using the first and second coupling portions to be used as one tray for conveying the cup and the container.

Accordingly, in the figures, one body part 110 is configured to accommodate three cups, but this is just one embodiment, and is not limited thereto. That is, the body part 110 may accommodate all cups of a number required for accommodation by a scheme of fastening the plurality of body parts 110 regardless of the number of accommodated cups.

Meanwhile, the fastening portion 120 may be a cutting line which has only a predetermined length without a width and is formed to be cuttable through the perforated line. As the fastening portion 120 is configured by the cutting line, even though the food 300 is contained in the tray 100 for conveying the cup and the container, the food 300 may be prevented from being extracted to the fastening portion 120.

However, the present disclosure is not limited thereto, and the fastening portion 120 may be a slit having a predetermined length and a predetermined width.

In this case, the slit and the cutting line may be formed by pressing a perforating press or mold or a cutter mold. The slit and the cutting line may have at least one shape of an arc shape and a clamp shape (or V shape).

As a result, the slit and the cutting line may be fixed by inserting a protrusion 210 of the external member such as the cup holder 200. In this case, in the slit, the protrusion 210 may be naturally inserted into the hole having the predetermined width. Further, when the protrusion 210 is inserted into the cutting line, the protrusion 210 may be inserted while the cutting line is slightly widened.

For reference when the insertion of the protrusion 210 is completed, while the cutting line is closed by elasticity of the body part 110 itself, the protrusion 210 between the cutting lines is compressed, the cutting line may be rigidly fixed to a bottom of the body part 110. In particular, as the cutting line has the arc shape and the clamp shape (or V shape), elastic force may be provided to the protrusion inserted between the cutting lines to more rigidly fix the cutting line.

Meanwhile, as illustrated in FIGS. 1*a* and 2*a*, when the cutting line has the arc shape, first and second cutting branch lines may be provided on one end of the cutting line in a branched form so that the cutting line may be further elastically widened and the same components as the first and second cutting branch lines may be provided even on the other end of the cutting line based no the center of the cutting line.

Further, as illustrated in FIGS. 1*b*, 1*c*, and 2*b*, when the cutting line ha the clamp shape (or V shape), the protrusion 210 inserted into the cutting line is inserted while being transformed to the clamp shape. In this case, the protrusion 210 may be fixed by the elastic force of the cutting line 120 itself and an operation feel widened outwards by an elastic restoration force of the protrusion 210 itself due to the transformation of the protrusion 210 may be generated, and as a result, the protrusion 210 may be more rigidly fixed to the fastening portion 120 than the case where the cutting line has the arc shape. This may more effectively prevent the cup holder 200 and the containers 200*b* and 200*d* from being separated due to external impact when conveying multiple cups and containers. Meanwhile, the cutting branch line may have only a length without the width similarly to the cutting line, and may be cut and formed together when the cutting line is cut and formed by pressing by the cutter mold.

Meanwhile, as the slit has a hole having a predetermined width, the slit may not be rigidly fixed when the insertion of the protrusion 210 is completed. In order to prevent this, as the slit has the arc shape and the clamp shape (or V shape) like the cutting line, the elastic force and a restoration force may be provided to the protrusion 210 inserted between the slits, and as a result, the slit may be rigidly fixed.

However, the slit may have lower fixation power to the body part 110 and the protrusion 210 than the cutting line. In order to solve this, the slit may further include an adhesive member for attaching the protrusion 210 penetrated through the slit on the bottom surface at one side of the bottom surface of the body part 110. In this case, the adhesive member may be provided while being attached to the bottom surface of the body part 110.

As an example, when the protrusion 210 is inserted into the slit and exposed to the bottom surface of the body part 110, the adhesive member is attached to one surface of the exposed protrusion 210. Through this, the protrusion inserted into the slit may be more rigidly fixed.

FIG. 5 is a perspective view illustrating a state in which the tray for conveying a cup and a container is folded in order to storage the tray for conveying a cup and a container according to the embodiment of the present invention.

As illustrated in FIG. 5, in the tray 100 for conveying the cup and the container according to the present invention, a surface which extends to the bottom portion may be folded inside. As an example, the tray 100 for conveying the cup and the container is kept in a folding state, and the folded surface is erected in use in order to accommodate the cup and the food, and the protrusion 210 provided in the cup holder 200*a* and the containers 200*b* and 200*c* are fitted into the fastening portion 120 to be completed.

Meanwhile, in FIG. 5, the tray 100 for conveying the cup and the container is configured in a completed box form, however, the tray 100 for conveying the cup and the container is configured to be used through only a folding and unfolding process. However, this is just one embodiment, and the present invention is not limited thereto. That is, the tray 100 for conveying the cup and the container may be configured by one sheet of rectangular paper without using an adhesive, and the tray 100 for conveying the cup and the container may be implemented by folding and fitting.

However, the tray 100 for conveying the cup and the container according to the present invention can be immediately used without the manufacturing process and does not occupy a large volume in the simple structure of the plate shape configured only by an outer periphery and is simple in terms of the manufacturing process to save cost. Further, the tray for conveying the cup and the container can save a material and more stably support the cup in a simple and robust structure.

FIG. 6 is a perspective view illustrating a configuration of a tray for conveying a cup and a container according to another embodiment of the present invention.

As illustrated in FIG. 6, the tray for conveying a cup and a container according to the present invention may include a body part 110 in which a space accommodating at least one of the cup and the container, at least one fastening portion 120 provided on a bottom surface of the body part 110 and in which the protrusion 210 of the external member 200 is inserted and coupled, and a fixation bar 200*d* having at least one pole so as to be penetrated, inserted, and bound into the fastening portion 120 on a bottom of the body part 110 and protrude upward on the bottom surface of the body part 110.

In this case, the tray for conveying the cup and the container according to another embodiment illustrated in FIG. 6 may be configured equally to the configuration of the tray for conveying the cup and the container described with reference to FIGS. 1 to 5 above. However, the tray may further include the fixation bar 200*d*.

The fixation bar 200*d* as a component for accommodating both the cup and the food 300 in the body part 110 may support the food 300 including desserts such as cakes, donuts, confectionery, braking, etc., on one side or both sides by using at least one pole so as to protrude upwards from the bottom surface of the body part 110.

Likewise, the fixation bar 200*d* may include or be coated with paper, plastic, metal, and all or some thereof, which have a support force in order to support the food 300 on one side or both sides.

FIGS. 7(*a*) and 7(*b*) are configuration diagrams specifically illustrating a configuration of a fixation bar in FIG. 6. In this case, FIG. 7(*a*) is a configuration diagram illustrating an unfolding state of the fixation bar and FIG. 7(*b*) is a configuration diagram illustrating a folding state of the fixation bar.

As illustrated in FIG. 7(*a*), the fixation bar 200*d* may be provided as a plate part having a predetermined width, and may have a folding line 201 having a predetermined distance while both centers correspond to each other. Meanwhile, the fixation bar 200*d* may further include the folding line 201 slantly inwards of the center by extending the folding line 201.

In addition, as illustrated in FIG. 7(*b*), as the fixation bar 200*d* is bent inward along the folding line 201, a central surface may be configured by a plate part having a predetermined width, and both side surfaces may be configured by clamp-shaped (or V-shaped) poles.

In addition, the clamp-shaped (or V shaped) pole of the fixation bar 200*d* is penetrated, inserted, and fastened into the cutting line of the fastening portion 120 and protrudes upwards from the bottom surface of the body part 110, and the central surface of the fixation bar 200*d* may be in close contact with a lower end of the body part 110.

In this case, as the cutting line of the fastening portion 120 is configured in the clamp shape (or V shape), elastic force and a surface friction force of the cutting line itself are generated, and the fixation bar 200*d* penetrated, inserted, and fastened into the cutting line of the fastening portion 120 may be rigidly fixed to the fastening portion 120. In this case, the fixation bar 200*d* is penetrated and inserted toward an upper end from the lower end of the body part 110 to prevent the fixation 200*d* from being separated downward from the body part 110 when conveying the tray for conveying the cup and the container.

Meanwhile, only the case where the cutting line of the fastening portion 120 has the clamp shape (or V shape) is described, but when the shape of the cutting line of the fastening portion 120 is changed, the shape of the fixation bar 200*a* should also be changed in response thereto.

FIG. 8 is a configuration diagram illustrating a configuration in which a fixation bar and a cup holder are coupled to a body part in FIG. 6.

As illustrated in FIG. 8, in the case of the tray for conveying the cup and the container according to the present invention, the protrusion 210 of the external member 200 such as the cup holder may be coupled in an upper portion of the body part 110 and the pole of the fixation bar 220*d* bent inwards along the folding line 201 may be inserted and coupled in a lower portion of the body part 110.

FIG. 9 is a perspective view illustrating a state in which a cup and a food are accommodated in a tray for conveying a cup and a container according to another embodiment of the present invention in FIG. 6.

As illustrated in FIG. 9, in the case of the tray for conveying the cup and the container according to the present invention, a beverage cup 400 is received in the cup holder 200*a* coupled to the upper portion of the fastening portion 120.

In addition, the fixation bar 200*d* coupled to the lower portion of the fastening portion 120 supports the food 300 including the desserts such as the cakes, the donuts, the confectionery, the baking, etc., on one side or both sides by using at least one pole so as to protrude upwards to prevent the food 300 from being discharged.

For understanding of the disclosed embodiments, reference numerals are described in the preferred embodiments shown in the drawing, and specific terms are used to describe the disclosed embodiments, but the embodiments disclosed by the specific terms are not limited, and the disclosed embodiments may include all components that those skilled in the art may generally consider.

Unless otherwise specified, like "essential", "important", etc., described in the disclosed embodiment, the corresponding components may not be components particularly required for application of the disclosed embodiment. Further, it will also be appreciated by those skilled in the art that various embodiments can be made within the scope of the technical spirit of the present invention. Accordingly, the true technical scope of the present invention should be defined by the technical spirit of the appended claims.

EXPLANATION OF REFERENCE NUMERALS AND SYMBOLS

100: Try for conveying cup and container
110: Body part
120: Fastening portion
130: Handle
140*a*, 140*b*, 150*a*, 150*b*: Coupling portion
200, 200*a*, 200*b*, 200*c*: External member (cup holder and container)
200*d*: Fixation bar
210: Protrusion

300: Food

400: Beverage cup

The invention claimed is:

1. A tray for conveying a cup and a container, the tray comprising:

a body part having an opened-box shape and a space therein to accommodate at least one of a cup or a food;

at least one fastening portion positioned on one side of the body part; and external members positioned in the body part, each of the external members having a protrusion inserted and coupled into at least one fastening portion, wherein the external members comprise:

a cup holder having a hollow reverse truncated conical shape; and a container having a bottom surface and a peripheral wall extending upward from the bottom surface at a predetermined height, wherein each external member is independently positioned in the body part such that no external member contacts another external member, thereby maintaining a predetermined separation distance between adjacent external members, wherein the fastening portion has a slit or a cutting line having a clamp shape.

* * * * *